United States Patent [19]

Teerman et al.

[11] Patent Number: 4,741,478

[45] Date of Patent: May 3, 1988

[54] DIESEL UNIT FUEL INJECTOR WITH SPILL ASSIST INJECTION NEEDLE VALVE CLOSURE

[75] Inventors: Richard F. Teerman, Wyoming; Richard S. Knape, Grand Rapids, both of Mich.

[73] Assignee: General Motors Corporation, Detroit, Mich.

[21] Appl. No.: 935,841

[22] Filed: Nov. 28, 1986

[51] Int. Cl.[4] ..... F02M 47/02

[52] U.S. Cl. ..... 239/88; 239/126; 239/585

[58] Field of Search ..... 239/585, 533.3, 533.5, 239/88–96, 124–126; 123/446

[56] References Cited

U.S. PATENT DOCUMENTS 4,317,541 3/1982 Beardmore ..... 239/88

4,572,433 2/1986 Deckard ..... 239/88

*Primary Examiner*—Andres Kashnikow

*Assistant Examiner*—Karen B. Merritt

*Attorney, Agent, or Firm*—Arthur N. Krein

[57] ABSTRACT

A diesel unit fuel injector includes a pump assembly having an externally actuated plunger reciprocable in a bushing which with the plunger defines a pump chamber, with flow therefrom during an injection cycle portion of the pump stroke being directed to a fuel injection nozzle of the assembly. The injection nozzle includes a needle type differential area injection valve that is normally biased to a valve closed position by a valve return spring which is positioned in a spring chamber and which is operatively connected to the opposite end of the injection valve. Passage means, including orifice passage are used to direct spill flow from the pump chamber at the end of an injection cycle to the spring chamber to effect closure of the injection valve at a valve closing pressure which is greater than the valve opening pressure so that the pressure of the discharge of fuel at the end of an injection cycle is relatively great whereby to effect increased penetration of the discharged fuel into the associate combustion chamber of a diesel engine.

2 Claims, 2 Drawing Sheets

DIESEL UNIT FUEL INJECTOR WITH SPILL ASSIST INJECTION NEEDLE VALVE CLOSURE

This invention relates to unit fuel injectors of the type used to inject diesel fuel into the cylinders of a diesel engine and, in particular, to a diesel unit fuel injector having a spill assist injection needle valve closure.

DESCRIPTION OF THE PRIOR ART

Unit fuel injectors, of the so-called jerk type, are commonly used to pressure inject liquid fuel into an associate cylinder of a diesel engine. As is well known, such a unit injector includes a pump in the form of a plunger and bushing which is actuated, for example, by an engine-driven cam whereby to pressurize fuel to a suitable high pressure so as to effect the unseating of a pressure-actuated injection valve in the fuel injection nozzle incorporated into the unit injector.

In one form of such a unit injector, the plunger is provided with helices which cooperate with suitable ports in the bushing whereby to control the pressurization and therefore the injection of fuel during a pump stroke of the plunger.

In another form of such a unit injector, a solenoid valve is incorporated in the unit injector so as to control, for example, the drainage or spill flow of fuel from the pump chamber of the unit injector. In this latter type injector, fuel injection is controlled by the energization of the solenoid valve, as desired, during a pump stroke of the plunger whereby to terminate spill flow so as to permit the plunger to then intensify the pressure of fuel to effect the unseating of the injection valve of the associated fuel injection nozzle. Exemplary embodiments of such an electromagnetic unit fuel injector are disclosed, for example, in U.S. Pat. Nos. 4,129,255 and 4,129,256, both entitled, "Electromagnetic Unit Fuel Injector", and both issued Dec. 12, 1978, to Ernest Bader, Jr., John I. Deckard, and Dan B. Kuiper; 4,392,612, same title, issued July 12, 1983, to John I. Deckard and Robert D. Straub; and 4,550,875, entitled "Electromagnetic Unit Fuel Injector with Piston Assist Solenoid Actuated Control Valve", issued Nov. 5, 1985 to Teerman et al.

Normally, in both conventional mechanical and electromagnetic type unit fuel injectors, the injection valve opening pressure (VOP) is usually greater than the valve closing pressure (VCP) since the pressure flowing to and acting on the injection valve in a valve opening direction must be reduced significantly so as to allow the conventional valve return spring to bias the injection valve back to its valve closed position. Thus in such conventional unit fuel injectors, during the final stages of injection, the pressure of fuel being injected into an associate combustion chamber will be relatively lower than that encountered as at the beginning of injection up to the time at which the end of injection cycle is being initiated and thus at such lower fuel pressure on down to the valve closing pressures, the penetration of fuel into a combustion chamber is greatly reduced during the end portion of an injection cycle.

Accordingly, the desirability of controlling the valve closing pressure (VCP) such that it is at least substantially equal to or greater than the valve opening pressure (VOP) so as to obtain increased fuel penetration into an associate combustion chamber at or near the end of the an injection cycle has long been recognized.

To this end there is disclosed, for example, in U.S. Pat. No. 4,317,541, entitled "Fuel Injector-Pump Unit with Hydraulic Needle Fuel Injector", issued Mar. 2, 1982 to John M. Beardmore, a mechanical type unit fuel injector wherein the plunger of the pump assembly is provided with two helical grooves, one of which is used to control the flow of pressurized fuel to the spring chamber in the fuel injection nozzle assembly of such a unit injector whereby to assist a conventional valve return spring to effect closure of the injection valve such that the valve closing pressure (VCP) can be equal to or greater than the valve opening pressure.

In another example, an electromagnetic unit fuel injector is disclosed in U.S. Pat. No. 4,572,433, entitled "Electromagnetic Unit Fuel Injector", issued Feb. 25, 1986 to John I. Deckard, wherein pressurized fuel is supplied via a throttling orifice to a modulated pressure servo control chamber with a servo piston therein operatively associated with the injection valve of the associate fuel injection nozzle whereby to control the valve opening pressure (VOP) and valve closing pressure (VCP) as a function of engine speed.

SUMMARY OF THE INVENTION

The present invention provides a diesel electromagnetic or mechanical type unit fuel injector that includes a pump assembly having a plunger reciprocable in a bushing and operated, for example, by an engine-driven cam, with flow from the pump chamber, defined by the plunger and bushing during a pump stroke of the plunger being directed to a fuel injection nozzle assembly of the unit that contains a spring-biased, pressure-actuated, needle type, injection valve therein for controlling flow out through the spray tip outlets of the injection nozzle. At the end of an injection cycle, spill flow from the pump chamber can flow through one or more passage means into the chamber housing the valve return spring to thus generate therein, as controlled by spill flow return passages, a spill cavity pressure (SCP) which, in effect, is added to the normal valve spring closing pressure (VCP), whereby the injection valve will close at a combined pressure greater than its valve opening pressure (VOP).

It is therefore a primary object of this invention to provide an improved electromagnetic unit fuel injector that contains a solenoid-actuated control valve used to control the spill flow from an externally actuated plunger of the pump assembly of the unit injector, with part of the spill flow being directed to the spring cage cavity housing the valve return spring for the injection valve in the nozzle assembly of the unit injector, the rest of the spill flow flowing at a controlled rate via orifice passages to a source of low pressure fuel.

Another object of this invention is to provide an improved mechanical unit fuel injector wherein the externally actuated pump plunger of the pump unit thereof is provided with a helical groove therein and with lands on opposite sides of the helical groove which cooperate with suitable ports, including a spill port, to control the start and end of injection, the spill port being connected by a passage means to the spring cage cavity having the valve return spring therein for the injection valve of the nozzle assembly of the unit injector so that pressurized spill fuel can be used to assist the valve return spring to effect closure of the injection valve at a relatively high valve closing pressure, with at least one orifice passage means controlling spill flow back to a source of low pressure fuel.

For a better understanding of the invention, as well as other objects and further features thereof, reference is made to the following detailed description of the invention to be read in connection with the accompanying drawings.

DESCRIPTION OF THE PREFERRED EMBODIMENTS

Figure 1:
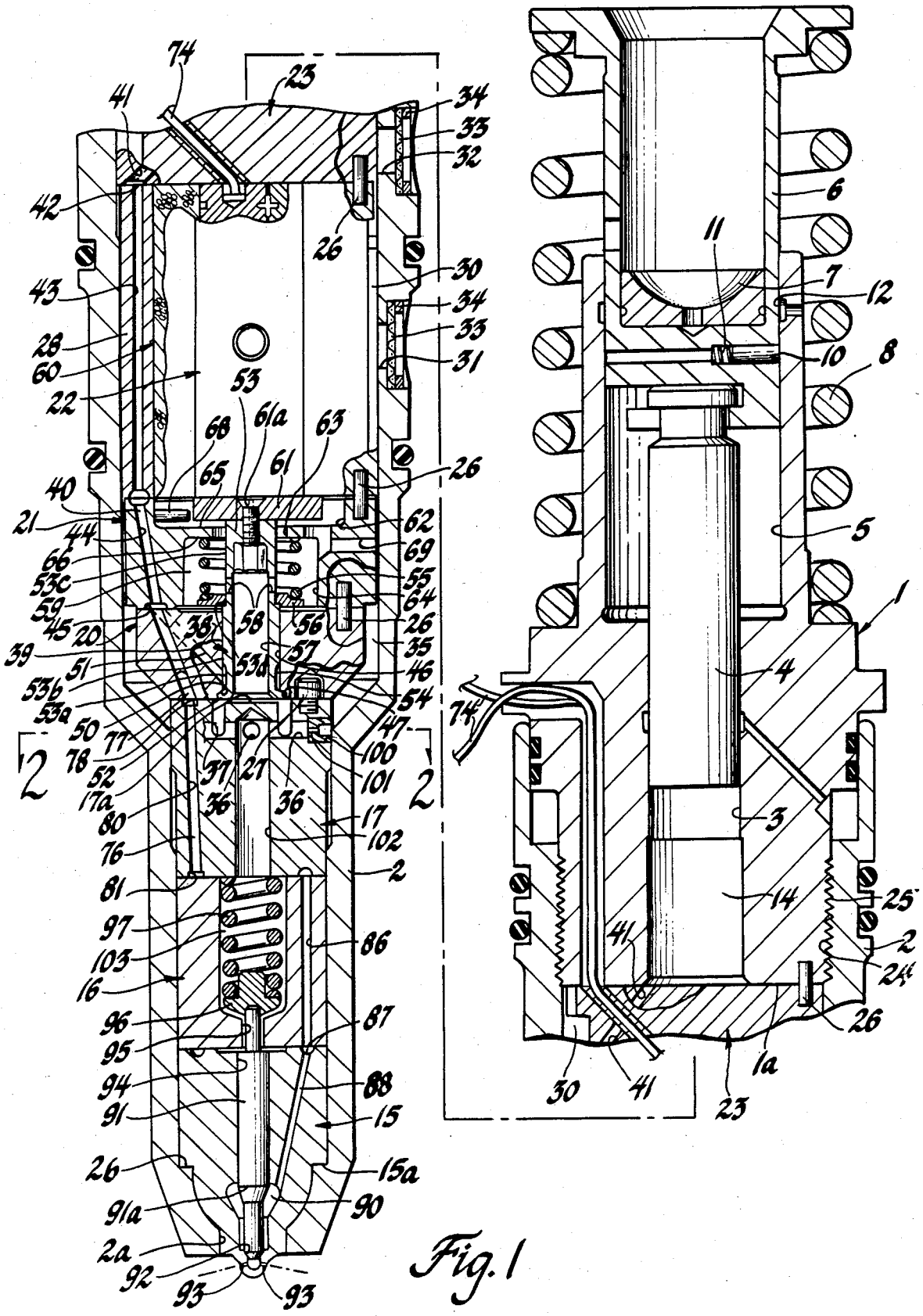
FIG. 1 is a longitudinal sectional view of an electromagnetic unit fuel injector in accordance with the invention with elements of the injector being shown so that the plunger of the pump thereof is positioned at the top of a pump stroke and with the electromagnetic valve means thereof energized, an with a spill assist injection needle injection valve closure arrangement in accordance with the invention incorporated therein.

Referring first to FIG. 1, there is shown an electromagnetic unit fuel injector constructed in accordance with the invention, that is, in effect, a unit fuel injector-pump assembly with an electromagnetic actuated control valve incorporated therein to control fuel discharge from the injector nozzle portion of this assembly and to control spill flow so as to effect the needle injection valve closure in accordance with the invention in a manner to be described in detail hereinafter. The pump portion, the solenoid actuated control valve, including the stator assembly thereof, and the stator spacer of this electromagnetic unit fuel injector being of the type disclosed in the above-identified U.S. Pat. No. 4,550,875, the disclosure of which is incorporated herein by reference thereto.

In the construction illustrated, the electromagnetic unit fuel injector has an injector body that includes a pump body 1 and a nut 2 that is threaded to the lower end of the pump body 1 to form an extension thereof. In the embodiment shown, the nut 2 is formed of stepped external configuration and with suitable annular grooves to receive O-ring seals whereby it is adapted to be mounted in a suitable injector socket, not shown, provided for this purpose in the cylinder head of an internal combustion engine, both not shown, the arrangement being such whereby fuel can be supplied to and drained from the electromagnetic fuel injector via internal fuel rails or galleries suitably provided for this purpose in the cylinder head, not shown, in a manner known in the art.

As best seen in the right hand portion of FIG. 1, the pump body 1 is provided with a stepped bore therethrough defining a cylindrical lower wall or bushing 3 to slidably receive a pump plunger 4 and an upper wall 5 of a larger internal diameter to slidably receive a cup-shaped plunger actuator follower 6 having a ball-socket follower button 7 therein. The follower 6 extends out one end of the pump body 1 whereby it through its follower button 7 and the plunger 4 connected to the follower is adapted to be reciprocated by an engine driven element, not shown, and by a plunger return spring 8 in a conventional manner. A stop pin 10 slidable in a radial aperture in the follower 6 is biased by a spring 11 in a radial direction so that it can enter an annular stop groove 12 provided for this purpose in the pump body 1 whereby to limit upward travel of the follower 6.

The pump plunger 4 forms with the bushing 3 a pump chamber 14 at the lower open end of the bushing 3, as shown in the right hand portion of FIG. 1.

As best seen in the left hand portion of FIG. 1, the nut 2 has an opening **2*a* at its lower end through which extends the lower end of a combined injector or spray tip valve body 15, hereinafter referred to as the spray tip, of a fuel injection nozzle assembly. As conventional, the spray tip 15 is enlarged at its upper end to provide a shoulder 15*a* which seats on an internal shoulder 2*b* provided by the stepped through bore in nut 2**.

Between the upper end of the spray tip 15 and the lower end of the pump body 1 there is positioned, in sequence starting from the spray tip 15, an injection valve spring cage 16, a control valve stop/director cage 17, a control valve cage 20, an armature spring cage 21, an electromagnetic stator assembly 22 and, a stator spacer 23, as shown in FIG. 1.

Nut 2, as shown in the right hand portion of FIG. 1, is provided with internal threads 24 for mating engagement with the external threads 25 at the lower end of the pump body 1. The threaded connection of the nut 2 to pump body 1 holds the spray tip 15, spring cage 16, the control valve stop/director cage 17, control valve cage 20, armature spring cage 21, stator assembly 22 and stator spacer 23 clamped and stacked end-to-end between the upper face **15*b* of the spray tip 15 an the bottom face 1*a* of the pump body 1**. All of these above-described elements have lapped mating surfaces whereby they are held in pressure sealed relationship to each other.

In addition, angular orientation of the stator spacer 23, stator assembly 22, armature spring cage 21, the control valve cage 20 and the valve stop/director cage 17 with respect to the pump body 1 and to each other is maintained by means of alignment pins 26 and positioned in suitable apertures in a conventional manner, only one such pin being shown in FIG. 1. In a similar manner, the control valve stop/director cage 17 is angularly positioned relative to the control valve cage 20 by means of one or more stepped alignment pins 27 positioned in suitable apertures provided for this purpose in the opposed faces of these elements, as shown in the left hand portion of FIG. 1.

As shown, the lower end of the stator spacer 23, the cage or housing 28 of the stator assembly 22 and the armature spring cage 21 each have the exterior surface thereof provided with flats, four such circumferentially spaced apart flats being used in the embodiment shown, whereby to define with the interior surface of the nut 2, a plurality of axial extending supply/drain passages 30.

Fuel is supplied to and drained from the supply/drain passages 30 by means of two sets of circumferentially spaced apart stepped radial inlet ports 31 and drain ports 32 provided in the wall of the nut 2 and which are axially spaced apart a predetermined distance for flow communication with, for example, an upper fuel supply rail and a lower fuel drain rail, respectively, provided in the cylinder head of an engine, not shown, since such an arrangement is well known in the art. In the embodiment shown, the nut 2 is provided with five each of such radial ports 31 and 32 with each havinq a fuel filter 33 positioned therein that is retained by means of a ring-like filter retainer 34 suitably fixed, as by staking in an associate radial port.

As illustrated, the control valve cage 20, which is of reduced exterior diameter relative to the surrounding internal wall diameter of the nut 2, and the upper end of the control valve stop/director cage 17 extending up into this wall portion of the nut 2 defines therewith the upper, annulus-shaped portion of a supply/drain chamber 35 that is in flow communication with the lower ends of the supply/drain passages 30. This supply/drain chamber 35 at its lower end is defined in part by a crossed pair of radial through passage means 36 provided adjacent to the upper end of the control valve stop/director cage 17, with these passage means 36 intersecting an annular groove 37, forming an additional part of the supply/drain chamber 35, the groove 37 extending axially downward from the upper end of the control valve stop/director cage 17 and radially located so as to be in flow communication with a supply/spill passage means 39 as controlled by a control valve 38, both to be described hereinafter.

The annular groove 37, in effect, encircles an upstanding boss, the upper surface 17*a* of which is depressed a predetermined distance beneath the normal upper surface of the control valve stop/director cage 17 and is thus positioned beneath the lower surface of the control valve cage 20 so as to serve as a stop for the control valve 38, to be described in detail hereinafter, as best seen in the left hand portion of FIG. 1.

The supply/drain chamber 35 and the pump chamber 14 are in flow communication with each other via a supply/spill passage means, generally designated 39, that extends from adjacent to the supply/drain chamber 35 so as to interconnect with a supply/discharge passage means 40 that opens at one end into the pump chamber 14, with flow through the supply/spill passage means 39 being controlled by a solenoid actuated, pressure balanced control valve 38, to be described in detail hereinafter.

Referring now first to the supply/discharge passage means 40, the upper end of this passage means, in the construction shown, is defined by a plurality of inclined through passages 41 formed in the stator spacer 23 so that their upper ends open into the pump chamber 14 while their lower ends open into a counterbored annular cavities 42 formed in the lower face of the stator spacer 23. Four such passages 41 and cavities 42 are provided in the stator spacer 23 in the embodiment illustrated, although only one such passage 41 and cavity 42 being shown in FIG. 1. The cavities 42 are, in turn, in flow communication with axially aligned, circumferentially spaced apart, stepped bore passages 43 extending through the stator housing 28 and which are each aligned at their lower ends with an associated one of the inclined stepped bore passages 44 that extend through the armature spring cage 21 so as to be in flow communication with an annular groove 45 provided in the lower surface of this armature spring cage 21. In the embodiment shown, there are four each of such passages 43 and 44, with only one each being shown in FIG. 1.

Referring now to the control valve cage 20, as best seen in the left hand portion of FIG. 1, it is provided with an axial stepped through bore defining an internal, cylindrical upper valve guide wall 46 and a lower wall 47 of larger internal diameter than valve guide wall 46, with these walls 46 and 47 being interconnected by a flat shoulder terminating at a conical valve seat 50 encircling valve guide wall 46. In addition, the control valve cage 20 is provide with circumferentially spaced apart, inclined supply/drain passages 51 which at one end, the upper end with reference to FIG. 1, are in flow communication with the annular groove 45 and, which at their opposite end open through the valve guide wall 46 at a location next adjacent to and above the valve seat 50, only one such supply/drain passage 51 being shown in this Figure.

Fuel flow between the supply/drain chamber 35 and the supply/drain passages 51 is controlled by means of the control valve 38 which is referred to as a pressure balanced valve of the type disclosed in the above-identified U.S. Pat. No. 4,392,612 patent, and which is in the form of a hollow poppet valve. The control valve 38 includes a head 52 with a conical valve seat surface thereon, and a stem 53 extending upward therefrom. The stem 53 includes a first stem portion 53*a* of reduced diameter next adjacent to the head 52 and of an axial extent so as to form with the guide wall 46 an annulus cavity 54 that is always in fuel communication with the supply/drain passages 51 during opening and closing movement of the control valve, the annulus cavity 54 and the supply/drain passages 51 thus defining the supply/spill passages means 37. The stem 53 also includes a guide stem portion 53*b* of a diameter to be slidably guided in the valve stem guide wall 46, and an upper reduced diameter portion 53*c* that extends axially through a stepped bore in the armature/valve spring cage 21. Stem portions 53*b* and 53*c* are interconnected by a flat shoulder 53*d*.

The control valve 38 is normally biased in a valve opening direction, downward with reference to FIG. 1, by means of a coil spring 55 loosely encircling the portion 53*c* of the valve stem 53. As shown, one end of the spring 55 abuts against a washer-like spring retainer 56 encircling stem portion 53*c* so as to abut against shoulder 53*d*. The other end of spring 55 abuts against an apertured internal shoulder 66 of the armature spring cage 21.

In addition, the head 52 and stem 53 of the control valve 38 are provided with a stepped blind bore so as to materially reduce the weight of this valve and so as to define a pressure relief passage 57 of a suitable axial extent whereby at its upper end it can be placed in fluid communication via radial ports 58 with a valve spring cavity 59 in the armature spring cage 21 and also through a central through aperture, not numbered, in the screw 61*a* used to secure an armature 61, to be described next hereinafter, to the control valve 38. The aperture in screw 61*a* permits fuel flow therethrough to help reduce viscous damping and spill pressure which may force fuel into the airgap, to be described hereinafter, to also assist in more rapid opening of the control valve 38.

Movement of the control valve 38 in a valve closing direction, that is to the position shown in FIG. 1, is effected by means of a solenoid assembly 60, which includes the armature 61 which is of rectangular flat shaped configuration and which is fixed as by a flat head apertured screw 61*a* to the upper end of the stem 53 of control valve 38.

As shown, the armature spring cage 21 is provided with a stepped through bore which defines an upper wall 62 of a size to loosely receive the armature 61, an intermediate wall 63 of a diameter to loosely receive the stem portion 53*c* of the control valve 38 and a lower wall 64 of a diameter to loosely receive the spring 55 and spring retainer 56. Walls 62 and 63 are interconnected by a flat shoulder 65 which forms with the wall 62 an armature cavity for the armature 61 while walls 63 and 64 are interconnected by a flat shoulder 66 against which, as previously described, the upper end of spring 55 abuts.

A radial opening, not shown, opens through wall 62 of the armature spring cage 21 to secure an armature spin stop pin 68 extending therethrough and is thus positioned so as to prevent rotation of the armature 61. In addition, one or more radial ports 69 open through the lower wall 64 to provide for fluid communication between the cavity containing the spring 55 and the adjacent supply/drain passages 30. Also, as shown, the outer upper peripheral surface of the armature spring cage is provide with spaced apart recessed portions 21*a* to define with the lower surface of the stator assembly 22 a number of passages to permit flow between the supply/drain passages and the armature cavity.

The solenoid assembly 60, as conventional, includes the stator assembly 22 having the tubular outer stator housing 28. As conventional, a coil bobbin supporting a wound stator or solenoid coil and a multi-piece pole piece, all not shown, are supported within the stator housing 28 by a retainer, not shown, made, for example, of a suitable plastic, with the lower surface of the pole piece, not shown, aligned with the lower surface of the stator housing all in a manner as described and shown in the above-identified U.S. Pat. No. 4,550,875.

The total axial extent of the armature spring cage 21 and control valve cage 20 is selected relative to the axial extent of the control valve 38 and armature 61 so that, when the control valve 38 is in the closed position, the position shown in FIG. 1, a preselected clearance will exist between the opposed working surfaces of the armature 61 and of the pole piece, not shown, of the solenoid stator assembly 22 whereby a minimum fixed air gap will exist between these surfaces.

The solenoid coil, not shown, of the solenoid assembly 60, is connectable, by electrical conductors 74 extending through apertures provided for this purpose in the stator spacer 23 and pump body 1 to a suitable source of electrical power via a fuel injection electronic control circuit, not shown, whereby the solenoid coil, not shown, of the stator assembly 22 can be energized as a function of the operating conditions of an engine in a manner well known in the art.

During a pump stroke of the plunger 4, fuel is adapted to be discharged from the pump chamber 14 through the supply/discharge passage means 40 into the inlet end of a discharge passage means 76 to be described next hereinafter.

An upper part of this discharge passage means 76, includes inclined passages 77 provided in the control valve cage 20 so as to be in flow communication at one end with the groove 45 in the lower surface of the armature spring cage 21 and at their opposite ends with an annular groove 78 provided in the upper surface of the control valve stop/director cage 17. This groove 78 is in flow communication with one or more longitudinal passages 80 formed in the control valve stop/director cage 17, with the lower ends of the passage 80 opening into an annular groove 81 provided, for example, in the lower end of this cage 17.

This groove 81 is, in turn, in flow communication with one or more longitudinal passages 86 extending through the spring cage 16. The lower ends of each passage 86 is, in turn, connected by an annular groove 87 in the upper end of the spray tip 15 with at least one or more inclined passages 88 to a central passage 90 surrounding the lower end of the piston portion 91*a* of a conventional needle injection valve 91 movably positioned within the spray tip 15. At the lower end of passage 90 is an outlet for fuel delivery with an encircling tapered annular seat 92 for the injection valve 91 and, below the valve seat are one or more connecting spray orifices 93 located in the lower end of the spray tip 15.

The upper end of spray tip 15 is provided with a stepped bore 94 for guiding opening and closing movements of the injection valve 91. A reduced diameter upper end portion of the injection valve 91 extends through the central opening 95 in the spring cage 16, of conventional construction, and abuts against a spring seat 96. Compressed between the spring seat 96 and the director cage 17 is a valve return spring 97 which normally biases the injection valve 91 to its closed position shown.

Figure 2:
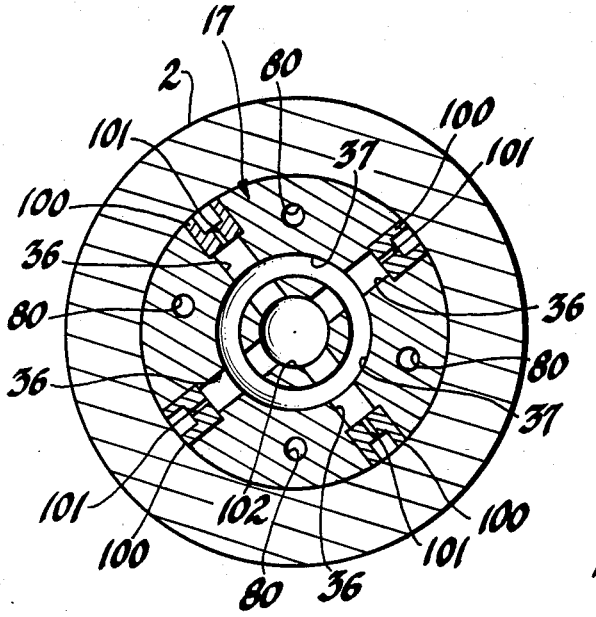
FIG. 2 is an enlarged cross-sectional view of the spill port portion of the electromagnetic unit fuel injector of FIG. 1, taken along line 2—2 of FIG. 1.

Now, in accordance with a feature of the invention and as best seen in FIGS. 1 and 2, each of the passage means 36 at their outboard ends are provided with an orifice plug 100 having an orifice passage 101 of predetermined cross-sectional flow area extending therethrough, with each orifice plug 100 being suitably fixed to the control valve stop/director cage 17. In addition, the control valve stop/director cage 17 is provided with an axial extending, relatively large diameter, blind bore passage 102, which at its upper end is in flow communication with the passage means 36 and opens at its lower end into the spring cavity or chamber 103 provided in the spring cage 16 so as to loosely receive the valve return spring 97.

The total cross-sectional flow area of the orifice passages 101 is preselected for a given unit fuel injector application, such that at the end of an injection cycle, as initiated by de-energization of the solenoid assembly 60, so as to permit spring 55 to effect opening of the control valve 38 for the spill flow of pressurized fuel being discharged during the continued pump stroke of the plunger 4, a large portion of this pressurized spill fuel flow will communicate via passage 102 with the fuel in the spring cavity 103 so as to provide a spill closing pressure (SCP) which acts on the upper exposed end of the needle injection valve 91 via opening 95 to thereby assist the valve return spring 97 to effect closure of the injection valve 91. Thus with this arrangement, the injection valve 91 will close at a predetermined valve closing pressure (VCP) that is greater than the valve opening pressure (VOP). At the same time a portion of the pressurized spill fuel flow will also flow out through the orifice passages 102 into the supply/drain chamber 35 containing fuel at a relatively low supply pressure.

However, the cross-sectional flow area of the orifice passages 101 should be such so as to permit reverse flow of fuel from the supply/drain chamber 35 at a suitable flow rate through the spill/supply passage means 36 whereby the pump chamber 14 can be filled, as during a suction stroke of the plunger 4, a time at which the solenoid assembly is de-energized, so that the control valve 38 will be open.

Functional Description

Referring now to FIG. 1, during engine operation, fuel from a fuel tank, not shown, is supplied, at a predetermined supply pressure, by a pump, not shown, to the subject electromagnetic unit fuel injector through a supply passage and annulus, not shown, in flow communication with the radial inlet ports 31. Fuel, as delivered through the inlet ports 31, flows into the supply/drain passage 30 and then into the supply/drain chamber 35, including the portion thereof defined by the passage means 36.

When the stator coil, not shown, of the stator assembly 22 is de-energized, the spring 55 is operative to open and hold open the control valve 38 such that the valve seat 50 and the head of the valve 38 will define a flow annulus. At the same time the armature 61, as connected to control valve 38, is also moved downward, with reference to FIG. 1, relative to the pole piece, not shown, of the stator assembly 22 whereby to establish a predetermined working air gap between the opposed working surfaces of these elements.

With the control valve 38 in its open position, fuel can flow from the supply/drain chamber 35 through the passage means 36, annular groove 37 and the flow annulus between the valve head 52 and its valve seat into the annulus cavity 54 and then via passage 51 and the supply/discharge passage means 40 into the pump chamber 14. Thus during a suction stroke of the plunger 4, the pump chamber will be resupplied with fuel. At the same time, fuel will be present in the discharge passage means 76 used to supply fuel to the injection nozzle assembly and in the bore passage 102 and spring cavity 103.

Thereafter, as the follower 6 is driven downward, as by a cam-actuated rocker arm, not shown, in a manner well known in the art, to effect downward movement of the plunger 4, this downward movement of the plunger will cause fuel to be displaced from the pump chamber 14 and will cause the pressure of the fuel in this chamber and the adjacent supply/discharge passages means 40 connected thereto to increase. However, with the stator coil, not shown, of the stator assembly 22 still de-energized, this pressure can only rise to a level that is a predetermined amount less than the "pop" pressure required to lift the needle valve 91 against the force of its associate return spring 97.

During this period of time, the fuel displaced from the pump chamber 14 can flow via the supply/spill passage means including the annulus cavity 54, annulus cavity 37 and the passage means 36 including orifice passages 101 back into the supply/drain chamber 35 and then from this chamber the fuel can be discharged via the supply/drain passages 30 and drain ports 32, for return, for example, via an annulus and passage, not shown, back to, for example, the engine fuel tank containing fuel at substantially atmospheric pressure.

As is conventional in the diesel fuel injection art, a number of electromagnetic unit fuel injectors can be connected in parallel to a common drain passage, not shown, which normally contains an orifice passage therein, not shown, used to control the rate of fuel flow through the drain passage whereby to permit fuel pressure at a predetermined supply pressure to be maintained in each of the injectors.

Thereafter, during the continued downward stroke of the plunger 4, an electrical (current) pulse of finite characteristic and duration (time relative, for example, to the top dead center of the associate engine piston position with respect to the camshaft and rocker arm linkage) supplied through the electrical conductors 74 to the stator coil, not shown, produces an electromagnetic field attracting the armature 61 to effect its movement toward the pole piece, not shown, of the stator assembly, that is, to the position shown in FIG. 1.

This upward movement, to the position shown in FIG. 1, of the armature 61 as coupled to the control valve 38, will effect closing of the control valve 38 against the valve seat 50, the position of these elements shown in FIG. 1. As this occurs, the drainage of fuel via the supply/drain passage 51 and the annulus cavity 54 will no longer occur and this then permits the plunger 4 to increase the pressure of fuel in the discharge passage means 76, to a "pop" or valve opening pressure level to effect unseating of the needle injection valve 91. This then permits the injection of fuel out through the spray orifices 93. Normally, the injection pressure increases during further continued downward movement of the plunger.

The control valve 38 has been referred to herein as being a pressure balanced valve, that is, it is a type of valve as disclosed in the above-identified United States patent having the angle of its valve seat surface selected relative to the angle of the valve seat 50 so that its seating engagement on the valve seat will occur at the edge interconnection of this valve seat 50 and the valve guide wall 46.

Ending the current pulse to the stator coil, not shown, causes the electromagnetic field to collapse, allowing the spring 55 to again open the control valve 38 and to also move the armature 61 to its lowered position. Opening of the control valve 38 again permits fuel flow via the supply/drain passages 51, the annulus cavity 54, the seat flow annulus between the valve seat 50 and now unseated valve seat surface 52 into the bore passage 102 and spring cavity 103 and into the supply/drain chamber 35 via the orifice passages 101 which control the rate of spill flow into this supply/drain chamber.

As this occurs, the pressure of fuel in passage 90 acting on the enlarged end of the needle valve 91 decreases, but substantially the same fluid pressure that exists in passage 90 will also be present in the spring cavity 103 to act on the upper end of the needle valve 91 via the opening 95 as a spring closing pressure (SCP), so that this pressure with the aid of the spring 97 will effect closure of the needle injection valve at a predetermined valve closing pressure (VCP) that is greater than the valve opening pressure (VOP). Accordingly, the fuel being discharged out through the spray orifices 93 up to the end of the injection cycle will be at a relatively high pressure, that is, at a pressure greater than the high valve opening pressure (VOP) so as to permit greater penetration of this discharged fuel into the associate combustion chamber, not shown.

Thus as an example, in a particular embodiment of a convention electromagnetic unit fuel injector, the valve opening pressure (VOP) is 4,000 psi, the valve closing pressure (VCP) is 3,000 psi and the maximum injection pressure is approximately 20,000 psi.

However, with such an injector modified with a spill assist injection needle valve closure arrangement incorporated therein in accordance with the subject invention as described hereinabove, the spill closing pressure (SCP) can be in the order of between 4,000 to 6,000 psi which, in effect, is added to the above-described valve closing pressure of 3,000 psi to provide an actual valve closing pressure in the order of 7,000 to 9,000 psi, as desired, by proper sizing of the orifice passages 101.

It should be appreciated that because of the more rapid closing of the needle type injection valve in the subject type electromagnetic unit fuel injector with spill assist injection valve closure that the electrical (current) pulse duration is increased, relative to a conventional electromagnetic unit fuel injector having no spill assist injection valve closure arrangement and, accordingly, with reference to the above referred to embodiment, the maximum injection pressure would increase correspondingly above 20,000 psi.

Figure 4:
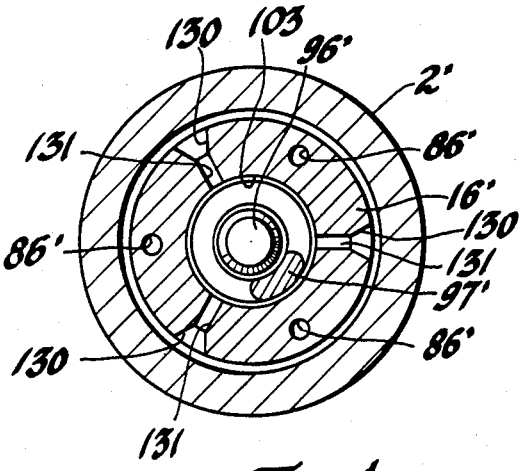
Figure 3:
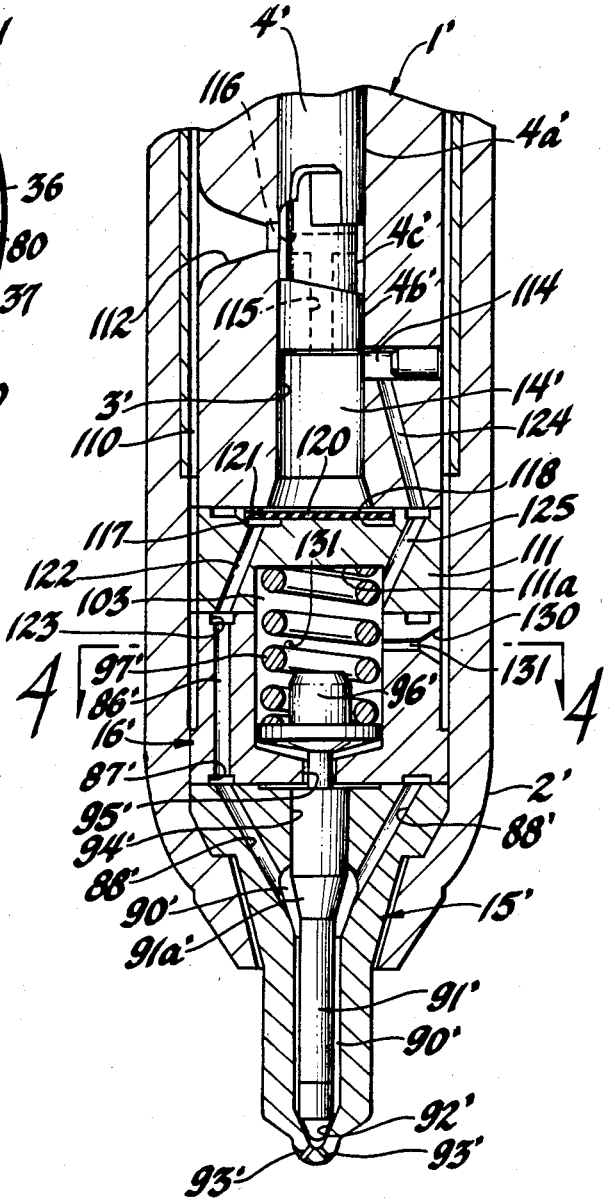
FIG. 3 is a longitudinal sectional view of the lower pump and nozzle portion of a mechanical type diesel unit fuel injector with a spill assist injection needle injection valve closure arrangement in accordance with the invention incorporated therein; and, FIG. 4 is a cross-sectional view of the nut and spring cage, per se, of the unit injector of FIG. 3, taken along line 4—4 of FIG. 3.

An alternate embodiment of the invention as incorporated in a mechanical unit fuel injector is shown in FIGS. 3 and 4, wherein similar parts are designated by similar numerals but with the addition of a suffix prime (') where appropriate.

Referring now in detail to FIG. 3, the upper portion of the mechanical unit fuel injector is conventional as shown, for example, in U.S. Pat. No. 3,075,707 Rademaker, the disclosure of which is incorporated herein, and includes a pump body 1' and a nut 2' threaded to the lower end of the pump body 1' in a manner similar to that shown in FIG. 1. In a manner similar to the structure shown in FIG. 1, the pump body 1' is proved with a bushing 3' in which an externally actuated pump plunger 4' is reciprocably received.

The pump plunger 4' forms with the bushing 3' a pump chamber 14'. An annular fuel reservoir or supply/drain chamber 110 surrounds the lower cylindrical portion of the pump body 1' within the nut 2' and is supplied via passages, not shown, in the pump body 1' and an external fuel connection, not shown, and it is also connected via passages, not shown, in the pump body 1' and an external connector, not shown, to a fuel drain line, also not shown, as conventional in the art. Also as shown in FIGS. 3 and 4, the supply/drain chamber 110 also extends axially downward so as to encircle a spring retainer 111 and at least an upper portion of a spring cage 16', both to be described hereinafter. The pressure of fuel in the supply/drain chamber 110 is normally maintained at a predetermined fuel supply pressure.

The plunger 4' has the usual spaced apart upper and lower lands **4*a*' and 4*b*', respectively, with a helical groove 4*c*' therebetween defining upper and lower helix land edges by which opening and closing of the supply/spill port 112 and spill port 114 in the lower portion of the pump body 1' are controlled, and an axial passage 115 and at least one interconnecting transverse passage 116 whereby the pump chamber 14' is placed in flow communication with the annulus cavity defined by the helical groove 4*c*' and the adjacent wall of the bushing 3'. As conventional, the angular position of the plungers helix edges relative to the ports 112 and 114** is controlled by a rack and pinion arrangement, not shown, in a conventional manner.

Clamped to the lower end of the pump body 1' by the nut 2' is a fuel injector nozzle assembly which includes a spray tip valve body or spray tip 15', an injection valve spring cage 16' and a spring retainer 111.

As shown in FIG. 3, the upper end of the spring retainer is provided with a cavity 117 facing the open end of the pump chamber 14', and projecting centrally upwardly from the cavity 117 is a protuberance 118 which forms a stop for a circular flat disc check valve 120. The cavity 117 extends radially beyond the lower extremities of the pump chamber 14' and the lower end of the pump body 1' forms a seat 121 for the check valve 120 as is conventional in the art.

Preferably a plurality of circumferentially spaced apart inclined passages 122 are provided to connect the cavity 117 with an annular groove 123 which in the construction shown, is provided in the upper surface of the spring cage 16'. Groove 123, in turn, is in flow communication with one or more longitudinal passages 86' extending through the spring cage 16' so as to open into an annular groove 87', provided in the construction illustrated in the lower end of the spring cage 16'. Groove 87' is in flow communication with at least one or more inclined passages 88' in the spray tip 15' to a central passage 90 surrounding the lower piston portion **91*a*' of a conventional needle type injection valve 91' movably positioned in the spray tip 15'. As previously described, at the lower end of passage 90' is an outlet for fuel delivery with an encircling frusto-conical annular valve seat 92' for the injection valve 91' and, below the valve seat 92' are one or more connecting spray orifices 93'**.

The upper end of the spray tip 15' is provided with the usual stepped bore 94' for guiding opening and closing movements of the injection valve 91'. As in the first embodiment, a reduced diameter upper end portion of the injection valve 91' extends through the central opening 95' in the spring cage 16' so as to abut against a spring seat 96'. Compressed between the spring seat 96' and the blind bore end surface **111*a* of the spring retainer 111 is a valve return spring 97', of a predetermined force, which normally biases the injection valve 91' to its closed position in abutment against the valve seat 92'**.

Now, in accordance with a feature of the invention as sued in a mechanical unit fuel injector and as shown in FIG. 1, the spill port 114 is in flow communication with one end of an inclined passage 124 provided in the pump body 1'. The opposite end of passage 123 is in flow communication with a stepped and inclined passage 125 provided in the spring retainer 111 so as to open into the spring cavity or chamber 103' provided in the spring cage 16' and in part in the spring retainer 111.

Spring cage 16', as best seen in FIGS. 3 and 4, is provided with preferably a plurality of radial extending orifice passages means 130, each having an orifice passage 131 portion of a predetermined cross-sectional flow area and location so as to effect flow communication between spring cavity 103 and the fuel reservoir 110.

Functional Description

Referring now to FIG. 3, during engine operation, fuel from a fuel tank, not shown, is supplied at a predetermined supply pressure by a pump, not shown, in a conventional manner to the fuel reservoir of supply/drain chamber 110. Accordingly, during a suction stroke of the plunger 4' and while at the position of the plunger 4' shown in this Figure, fuel can flow from the supply/drain chamber 110 through the supply/spill port 112 into the annulus cavity defined helical groove **4*c*' and then via transverse passage 116 and axial passage 115 into the variable volume pump chamber 14'. In addition when the plunger 4' is in the position shown, fuel can also flow from the supply/drain chamber 110 to the pump chamber 14' via the orifice passage means 130, including orifice passages 131, spring cavity 103 and passage 125 and 124 and spill port 114. With this arrangement, at the end of a suction stroke of the plunger 4' the pressure in the spring chamber 103 will correspond substantially to the fuel supply pressure present in the fuel reservoir 110**.

Thus thereafter during each downward or pump stroke of the plunger 4' from the position shown in FIG. 3, fuel is initially primarily bypassed to the supply/drain chamber 110 via the axial and transverse passages 115 and 116, respectively, in the plunger 4' and by the annular groove 4c' through the supply/spill port 112 and also via spill port 114, passages 124, 125, spring chamber 103 and the orifice passage means 130. However, after the spill port 114 is covered by the lower land 4b' and the supply/spill port 112 is covered by the upper land 4a', fuel will then be displaced under increasingly high pressure from the pump chamber 14' to the cavity 117 and passage 122, annular groove 123, passage 86', annular groove 87' and passages 88' into the central passage 90' to act on the differential area of the injection valve 91' to effect its opening at a predetermined valve opening pressure (VOP) to thus initiate an injection cycle for the discharge of fuel from the spray orifices 93'.

The pressure of fuel being discharged will increase during further downward movement of the plunger 4' until such time as the plunger 4' reaches a position at which the helical groove 4c' comes into registration with the spill port 114, at which time pressurized fuel is, in effect, spilled via the axial and transverse passage 115 and 116 and groove 4c' into the spill port for flow via passages 124 and 125 into the spring cavity 103 from which fuel is discharged or spilled at a controlled rate via the orifice passage means 130 into the supply/drain chamber 110.

As the above spill flow occurs, the pressure of fuel in the central passage 90' acting on the injection valve 91' in a valve opening direction decreases while at the same time the pressure of fuel in the spring chamber 103, that is the spill cavity pressure (SCP) acting on the injection valve 91' in a valve closing direction together with the bias force of the valve return spring 97' will effect closure of the injection valve 91' by a combined pressure that is a predetermined amount greater, as desired, than the valve opening pressure (VOP).

Accordingly, up to the actual end of an injection cycle, all of the fuel discharged through the spray orifice will be at relatively high pressures to insure proper penetration of the jets of fuel discharged therefrom into the associate combustion cylinder, not shown.

While the invention has been described with reference to the structures disclosed herein, it is not confined to the specific details set forth, since it is apparent that various modifications and changes can be made by those skilled in the art. This application is therefore intended to cover such modifications or changes as may come within the purposes of the improvements or scope of the following claims.

The embodiments of the invention in which an exclusive property or privilege is claimed are defined as follows:

1. In a diesel unit fuel injector of the type including a pump cylinder with an externally actuated plunger reciprocable therein to define a pump chamber open at one end in which fuel is pressurized during a pump stroke of the plunger, fuel supply/drain means for supplying fuel to said pump chamber, a fuel injection nozzle means operatively connected to said pump chamber, said fuel injection nozzle including a spray tip with fuel spray outlet means at the free end thereof which is in flow communication with said pump chamber, an injection valve having one end thereof movable to open and close said fuel spray outlet means, a spring chamber, a valve return spring positioned in said spring chamber and operatively connected to the opposite end of said injection valve to normally bias said injection valve in a direction to close said fuel spray outlet means, and spill flow control means operatively connected to said pump chamber to effect spill flow of fuel during a pump stroke of said plunger whereby to control the start and end of injection, the improvement wherein said spill flow control means includes a supply/drain passage means in flow communication at one end with said pump chamber; said supply/drain means being operatively connectable at one end to a source of fuel at a predetermined supply pressure and having orifice passage means next adjacent to its opposite end; a flow control valve means controlling flow between opposite end of said supply drain passage means and said opposite end of said supply/drain means; and, a passage means interconnecting said spring chamber and said supply/drain means upstream of said orifice passage means in terms of the direction of spill flow from said pump chamber out through said orifice passage means for the spill flow of fuel to said spring chamber, the arrangement being such that said injection valve will open when supplied with pressurized fuel at a predetermined valve opening pressure and will close at a higher pressure as a result of the spill flow of pressurized fuel from the pump chamber into said spring chamber acting with the valve return spring to effect movement of said injection valve to close said spray outlet means.

2. In a diesel electromagnetic unit fuel injector of the type including a pump cylinder with an externally actuated plunger reciprocable therein to define a pump chamber open at one end, fuel supply/drain means for supplying fuel to said pump chamber, a fuel injection nozzle means operatively connected to said pump chamber, said fuel injection nozzle including a spray tip with fuel spray outlet means at the free end thereof which is in flow communication with said pump chamber, an injection valve having one end thereof movable to open and close said fuel spray outlet means, a spring chamber, a valve return spring returned in said spring chamber and operatively connected to the opposite end of said injection valve to normally bias said injection valve in a direction to close said fuel spray outlet means, and a solenoid actuated valve spill flow control means operatively connected to said pump chamber and to said fuel supply/drain means to effect spill flow of fuel during a pump stroke of said plunger whereby to control the start and end of injection, the improvement wherein said supply/drain means is operatively connectable at one end to a source of fuel at a predetermined supply pressure and includes orifice passage means next adjacent to its opposite end and wherein said spill flow control means also includes a supply/drain passage means in flow communication at one end with said pump chamber; a flow control valve means controlling flow between said opposite end of said supply/drain passage means and the opposite end of said supply/drain means; and, a passage means interconnecting said spring chamber and said opposite end of said supply/drain means upstream of said orifice passage means in terms of the direction of spill flow from said pump chamber via said orifice passage means for the spill flow of fuel from said pump chamber directly to said spring chamber, the arrangement being such that said injection valve will open when supplied with pressurized fuel at a predetermined valve opening pressure and will close at a higher pressure as a result of the spill flow of pressurized fuel from said pump chamber into said spring chamber acting with the valve return spring to effect movement of said injection valve to close said spray outlet means to thereby terminate injection.

* * * * *